US007922285B2

(12) United States Patent
Karppinen et al.

(10) Patent No.: US 7,922,285 B2
(45) Date of Patent: Apr. 12, 2011

(54) METHOD OF CLEANING A PRINTHEAD USING LIQUID FOAM

(75) Inventors: Vesa Karppinen, Balmain (AU); Kia Silverbrook, Balmain (AU); John Douglas Peter Morgan, Balmain (AU); David John Worboys, Balmain (AU); Patrick John McAuliffe, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 0 days.

(21) Appl. No.: 12/535,677

(22) Filed: Aug. 4, 2009

(65) Prior Publication Data

US 2009/0289988 A1 Nov. 26, 2009

Related U.S. Application Data

(63) Continuation of application No. 11/495,815, filed on Jul. 31, 2006, now Pat. No. 7,581,812.

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS

| | | | | |
|---|---|---|---|---|
| 3,990,793 | A * | 11/1976 | Anzai et al. | 399/223 |
| 5,786,829 | A * | 7/1998 | Pasciak et al. | 347/28 |
| 5,847,727 | A | 12/1998 | VanLew et al. | |
| 6,017,110 | A | 1/2000 | Jackson | |
| 6,336,699 | B1 * | 1/2002 | Sarkissian et al. | 347/33 |
| 6,604,809 | B2 * | 8/2003 | Katsuragi et al. | 347/28 |
| 6,629,750 | B2 | 10/2003 | Ciordia | |
| 2004/0145623 | A1 | 7/2004 | Choi | |
| 2007/0015085 | A1 | 1/2007 | Kawamura | |

FOREIGN PATENT DOCUMENTS

| | | | |
|---|---|---|---|
| DE | 10030165 | A1 | 1/2002 |
| JP | 09-226147 | A | 9/1997 |
| JP | 11-198396 | A | 7/1999 |
| NL | 1002547 | C1 | 9/1997 |

* cited by examiner

*Primary Examiner* — Stephen D Meier
*Assistant Examiner* — Alexander C Witkowski

(57) ABSTRACT

A method of cleaning an inkjet printhead, by generating a liquid foam on the ink ejection face such that particulate contaminants on the ejection surface disperse into the foam, then transferring the foam, together with the particulate contaminants dispersed within, onto a rotatable transfer surface moving relative said ejection face and, rotating the rotatable transfer surface into contact with a removal surface to remove the foam and the particulate contaminants dispersed within. Ink consumption is minimized by use of a foam and damage to the face is avoided since the rotatable transfer surface does not contact the face.

15 Claims, 7 Drawing Sheets

METHOD OF CLEANING A PRINTHEAD USING LIQUID FOAM

CROSS REFERENCE TO RELATED APPLICATION

This application is a continuation of U.S. application Ser. No. 11/495,815 filed Jul. 31, 2006, now issued U.S. Pat. No. 7,581,812, all of which are herein incorporated by reference.

FIELD OF THE INVENTION

This invention relates to inkjet printhead maintenance. It has been developed primarily for facilitating maintenance operations, such as cleaning particulates from an ink ejection face of the printhead.

CO-PENDING APPLICATIONS

The following applications have been filed by the Applicant simultaneously with application Ser. No. 11/495,815:

| | | | | |
|---|---|---|---|---|
| 11/495,816 | 11/495,817 | 11/495,814 | 11/495,823 | 11/495,822 |
| 7,523,672 | 11/495,820 | 11/495,818 | 11/495,819 | |

The disclosures of these co-pending applications are incorporated herein by reference.

CROSS REFERENCES TO RELATED APPLICATIONS

Various methods, systems and apparatus relating to the present invention are disclosed in the following US patents/patent applications filed by the applicant or assignee of the present invention:

| | | | | |
|---|---|---|---|---|
| 6,750,901 | 6,476,863 | 6,788,336 | 7,249,108 | 6,566,858 |
| 6,331,946 | 6,246,970 | 6,442,525 | 7,346,586 | 09/505,951 |
| 6,374,354 | 7,246,098 | 6,816,968 | 6,757,832 | 6,334,190 |
| 6,745,331 | 7,249,109 | 7,197,642 | 7,093,139 | 7,509,292 |
| 10/636,283 | 10/866,608 | 7,210,038 | 7,401,223 | 10/940,653 |
| 10/942,858 | 7,364,256 | 7,258,417 | 7,293,853 | 7,328,968 |
| 7,270,395 | 7,461,916 | 7,510,264 | 7,334,864 | 7,255,419 |
| 7,284,819 | 7,229,148 | 7,258,416 | 7,273,263 | 7,270,393 |
| 6,984,017 | 7,347,526 | 7,357,477 | 7,465,015 | 7,364,255 |
| 7,357,476 | 11/003,614 | 7,284,820 | 7,341,328 | 7,246,875 |
| 7,322,669 | 7,445,311 | 7,452,052 | 7,455,383 | 7,448,724 |
| 7,441,864 | 11/482,975 | 11/482,970 | 11/482,968 | 11/482,972 |
| 11/482,971 | 11/482,969 | 7,506,958 | 7,472,981 | 7,448,722 |
| 11/246,679 | 7,438,381 | 7,441,863 | 7,438,382 | 7,425,051 |
| 7,399,057 | 11/246,671 | 11/246,670 | 11/246,669 | 7,448,720 |
| 7,448,723 | 7,445,310 | 7,399,054 | 7,425,049 | 7,367,648 |
| 7,370,936 | 7,401,886 | 7,506,952 | 7,401,887 | 7,384,119 |
| 7,401,888 | 7,387,358 | 7,413,281 | 7,530,663 | 7,467,846 |
| 11/482,962 | 11/482,963 | 11/482,956 | 11/482,954 | 11/482,974 |
| 11/482,957 | 11/482,987 | 11/482,959 | 11/482,960 | 11/482,961 |
| 11/482,964 | 11/482,965 | 7,510,261 | 11/482,973 | 6,623,101 |
| 6,406,129 | 6,505,916 | 6,457,809 | 6,550,895 | 6,457,812 |
| 7,152,962 | 6,428,133 | 7,416,280 | 7,252,366 | 7,488,051 |
| 7,360,865 | 11/482,980 | 11/482,967 | 11/482,966 | 11/482,988 |
| 11/482,989 | 7,438,371 | 7,465,017 | 7,441,862 | 11/293,841 |
| 7,458,659 | 7,455,376 | 11/124,158 | 11/124,196 | 11/124,199 |
| 11/124,162 | 11/124,202 | 11/124,197 | 11/124,154 | 11/124,198 |
| 7,284,921 | 11/124,151 | 7,407,257 | 7,470,019 | 11/124,175 |
| 7,392,950 | 11/124,149 | 7,360,880 | 7,517,046 | 7,236,271 |
| 11/124,174 | 11/124,194 | 11/124,164 | 7,465,047 | 11/124,195 |
| 11/124,166 | 11/124,150 | 11/124,172 | 11/124,165 | 7,566,182 |
| 11/124,185 | 11/124,184 | 11/124,182 | 11/124,201 | 11/124,171 |
| 11/124,181 | 11/124,161 | 11/124,156 | 11/124,191 | 11/124,159 |

-continued

| | | | | |
|---|---|---|---|---|
| 7,370,932 | 7,404,616 | 11/124,187 | 11/124,189 | 11/124,190 |
| 7,500,268 | 7,558,962 | 7,447,908 | 11/124,178 | 11/124,177 |
| 7,456,994 | 7,431,449 | 7,466,444 | 11/124,179 | 11/124,169 |
| 11/187,976 | 11/188,011 | 7,562,973 | 7,530,446 | 11/228,540 |
| 11/228,500 | 11/228,501 | 11/228,530 | 11/228,490 | 11/228,531 |
| 11/228,504 | 11/228,533 | 11/228,502 | 11/228,507 | 11/228,482 |
| 11/228,505 | 11/228,497 | 11/228,487 | 11/228,529 | 11/228,484 |
| 7,499,765 | 11/228,518 | 11/228,536 | 11/228,496 | 7,558,563 |
| 11/228,506 | 11/228,516 | 11/228,526 | 11/228,539 | 11/228,538 |
| 11/228,524 | 11/228,523 | 7,506,802 | 11/228,528 | 11/228,527 |
| 7,403,797 | 11/228,520 | 11/228,498 | 11/228,511 | 11/228,522 |
| 11/228,515 | 11/228,537 | 11/228,534 | 11/228,491 | 11/228,499 |
| 11/228,509 | 11/228,492 | 7,558,599 | 11/228,510 | 11/228,508 |
| 11/228,512 | 11/228,514 | 11/228,494 | 7,438,215 | 11/228,486 |
| 11/228,481 | 11/228,477 | 7,357,311 | 7,380,709 | 7,428,986 |
| 7,403,796 | 7,407,092 | 11/228,513 | 11/228,503 | 7,469,829 |
| 11/228,535 | 7,558,597 | 7,558,598 | 6,238,115 | 6,386,535 |
| 6,398,344 | 6,612,240 | 6,752,549 | 6,805,049 | 6,971,313 |
| 6,899,480 | 6,860,664 | 6,925,935 | 6,966,636 | 7,024,995 |
| 7,284,852 | 6,926,455 | 7,056,038 | 6,869,172 | 7,021,843 |
| 6,988,845 | 6,964,533 | 6,981,809 | 7,284,822 | 7,258,067 |
| 7,322,757 | 7,222,941 | 7,284,925 | 7,278,795 | 7,249,904 |
| 6,746,105 | 11/246,687 | 11/246,718 | 7,322,681 | 11/246,686 |
| 11/246,703 | 11/246,691 | 7,510,267 | 7,465,041 | 11/246,712 |
| 7,465,032 | 7,401,890 | 7,401,910 | 7,470,010 | 11/246,702 |
| 7,431,432 | 7,465,037 | 7,445,317 | 7,549,735 | 11/246,675 |
| 11/246,674 | 11/246,667 | 7,156,508 | 7,159,972 | 7,083,271 |
| 7,165,834 | 7,080,894 | 7,201,469 | 7,090,336 | 7,156,489 |
| 7,413,283 | 7,438,385 | 7,083,257 | 7,258,422 | 7,255,423 |
| 7,219,980 | 10/760,253 | 7,416,274 | 7,367,649 | 7,118,192 |
| 10/760,194 | 7,322,672 | 7,077,505 | 7,198,354 | 7,077,504 |
| 10/760,189 | 7,198,355 | 7,401,894 | 7,322,676 | 7,152,959 |
| 7,213,906 | 7,178,901 | 7,222,938 | 7,108,353 | 7,104,629 |
| 7,455,392 | 7,370,939 | 7,429,095 | 7,404,621 | 7,261,401 |
| 7,461,919 | 7,438,388 | 7,328,972 | 7,303,930 | 7,401,405 |
| 7,464,466 | 7,464,465 | 7,246,886 | 7,128,400 | 7,108,355 |
| 6,991,322 | 7,287,836 | 7,118,197 | 10/728,784 | 7,364,269 |
| 7,077,493 | 6,962,402 | 10/728,803 | 7,147,308 | 7,524,034 |
| 7,118,198 | 7,168,790 | 7,172,270 | 7,229,155 | 6,830,318 |
| 7,195,342 | 7,175,261 | 7,465,035 | 7,108,356 | 7,118,202 |
| 7,510,269 | 7,134,744 | 7,510,270 | 7,134,743 | 7,182,439 |
| 7,210,768 | 7,465,036 | 7,134,745 | 7,156,484 | 7,118,201 |
| 7,111,926 | 7,431,433 | 7,018,021 | 7,401,901 | 7,468,139 |
| 11/188,017 | 7,128,402 | 7,387,369 | 7,484,832 | 11/097,308 |
| 7,448,729 | 7,246,876 | 7,431,431 | 7,419,249 | 7,377,623 |
| 7,328,978 | 7,334,876 | 7,147,306 | 11/482,953 | 11/482,977 |
| 09/575,197 | 7,079,712 | 6,825,945 | 7,330,974 | 6,813,039 |
| 6,987,506 | 7,038,797 | 6,980,318 | 6,816,274 | 7,102,772 |
| 7,350,236 | 6,681,045 | 6,728,000 | 7,173,722 | 7,088,459 |
| 09/575,181 | 7,068,382 | 7,062,651 | 6,789,194 | 6,789,191 |
| 6,644,642 | 6,502,614 | 6,622,999 | 6,669,385 | 6,549,935 |
| 6,987,573 | 6,727,996 | 6,591,884 | 6,439,706 | 6,760,119 |
| 7,295,332 | 6,290,349 | 6,428,155 | 6,785,016 | 6,870,966 |
| 6,822,639 | 6,737,591 | 7,055,739 | 7,233,320 | 6,830,196 |
| 6,832,717 | 6,957,768 | 7,456,820 | 7,170,499 | 7,106,888 |
| 7,123,239 | 10/727,181 | 10/727,162 | 7,377,608 | 7,399,043 |
| 7,121,639 | 7,165,824 | 7,152,942 | 10/727,157 | 7,181,572 |
| 7,096,137 | 7,302,592 | 7,278,034 | 7,188,282 | 10/727,159 |
| 10/727,180 | 10/727,179 | 10/727,192 | 10/727,274 | 10/727,164 |
| 7,523,111 | 10/727,198 | 10/727,158 | 10/754,536 | 10/754,938 |
| 10/727,160 | 10/934,720 | 7,171,323 | 7,278,697 | 7,360,131 |
| 7,369,270 | 6,795,215 | 7,070,098 | 7,154,638 | 6,805,419 |
| 6,859,289 | 6,977,751 | 6,398,332 | 6,394,573 | 6,622,923 |
| 6,747,760 | 6,921,144 | 10/884,881 | 7,092,112 | 7,192,106 |
| 7,457,001 | 7,173,739 | 6,986,560 | 7,008,033 | 7,551,324 |
| 7,222,780 | 7,270,391 | 7,525,677 | 11/482,981 | 7,195,328 |
| 7,182,422 | 7,374,266 | 7,427,117 | 7,448,707 | 7,281,330 |
| 10/854,503 | 7,328,956 | 10/854,509 | 7,188,928 | 7,093,989 |
| 7,377,609 | 10/854,495 | 10/854,498 | 10/854,511 | 7,390,071 |
| 10/854,525 | 10/854,526 | 7,549,715 | 7,252,353 | 10/854,515 |
| 7,267,417 | 10/854,505 | 7,517,036 | 7,275,805 | 7,314,261 |
| 7,281,777 | 7,290,852 | 7,484,831 | 10/854,523 | 10/854,527 |
| 7,549,718 | 10/854,520 | 10/854,514 | 7,557,941 | 10/854,499 |
| 10/854,501 | 7,266,661 | 7,243,193 | 10/854,518 | 10/934,628 |
| 7,163,345 | 7,465,033 | 7,452,055 | 7,470,002 | 11/293,833 |
| 7,475,963 | 7,448,735 | 7,465,042 | 7,448,739 | 7,438,399 |
| 11/293,794 | 7,467,853 | 7,461,922 | 7,465,020 | 11/293,830 |
| 7,461,910 | 11/293,828 | 7,270,494 | 11/293,823 | 7,475,961 |
| 7,547,088 | 11/293,815 | 11/293,819 | 11/293,818 | 11/293,817 |
| 11/293,816 | 11/482,978 | 7,448,734 | 7,425,050 | 7,364,263 |

-continued

| | | | | |
|---|---|---|---|---|
| 7,201,468 | 7,360,868 | 7,234,802 | 7,303,255 | 7,287,846 |
| 7,156,511 | 10/760,264 | 7,258,432 | 7,097,291 | 10/760,222 |
| 10/760,248 | 7,083,273 | 7,367,647 | 7,374,355 | 7,441,880 |
| 7,547,092 | 10/760,206 | 7,513,598 | 10/760,270 | 7,198,352 |
| 7,364,264 | 7,303,251 | 7,201,470 | 7,121,655 | 7,293,861 |
| 7,232,208 | 7,328,985 | 7,344,232 | 7,083,272 | 7,261,400 |
| 7,461,914 | 7,431,441 | 11/014,764 | 11/014,763 | 7,331,663 |
| 7,360,861 | 7,328,973 | 7,427,121 | 7,407,262 | 7,303,252 |
| 7,249,822 | 7,537,309 | 7,311,382 | 7,360,860 | 7,364,257 |
| 7,390,075 | 7,350,896 | 7,429,096 | 7,384,135 | 7,331,660 |
| 7,416,287 | 7,488,052 | 7,322,684 | 7,322,685 | 7,311,381 |
| 7,270,405 | 7,303,268 | 7,470,007 | 7,399,072 | 7,393,076 |
| 11/014,750 | 11/014,749 | 7,249,833 | 7,524,016 | 7,490,927 |
| 7,331,661 | 7,524,043 | 7,300,140 | 7,357,492 | 7,357,493 |
| 7,566,106 | 7,380,902 | 7,284,816 | 7,284,845 | 7,255,430 |
| 7,390,080 | 7,328,984 | 7,350,913 | 7,322,671 | 7,380,910 |
| 7,431,424 | 7,470,006 | 11/014,732 | 7,347,534 | 7,441,865 |
| 7,469,989 | 7,367,650 | 7,469,990 | 7,441,882 | 7,556,364 |
| 7,357,496 | 7,467,863 | 7,431,440 | 7,431,443 | 7,527,353 |
| 7,524,023 | 7,513,603 | 7,467,852 | 7,465,045 | 11/482,982 |
| 11/482,983 | 11/482,984 | | | |

The disclosures of these applications and patents are incorporated herein by reference. Some of the above applications have been identified by their filing docket number, which will be substituted with the corresponding application number, once assigned.

BACKGROUND OF THE INVENTION

Inkjet printers are commonplace in homes and offices. However, all commercially available inkjet printers suffer from slow print speeds, because the printhead must scan across a stationary sheet of paper. After each sweep of the printhead, the paper advances incrementally until a complete printed page is produced.

It is a goal of inkjet printing to provide a stationary pagewidth printhead, whereby a sheet of paper is fed continuously past the printhead, thereby increasing print speeds greatly. The present Applicant has developed many different types of pagewidth inkjet printheads using MEMS technology, some of which are described in the patents and patent applications included in the cross reference list above.

The contents of these patents and patent applications are incorporated herein by cross-reference in their entirety.

Notwithstanding the technical challenges of producing a pagewidth inkjet printhead, a crucial aspect of any inkjet printing is maintaining the printhead in an operational printing condition throughout its lifetime. A number of factors may cause an inkjet printhead to become non-operational and it is important for any inkjet printer to include a strategy for preventing printhead failure and/or restoring the printhead to an operational printing condition in the event of failure. Printhead failure may be caused by, for example, printhead face flooding, dried-up nozzles (due to evaporation of water from the nozzles—a phenomenon known in the art as decap), or particulates fouling nozzles.

Particulates, in the form of paper dust, are a particular problem in high-speed pagewidth printing. This is because the paper is typically fed at high speed over a paper guide and past the printhead. Frictional contact of the paper with the paper guide generates large quantities of paper dust compared to traditional scanning inkjet printheads, where paper is fed much more slowly. Hence, pagewidth printheads tend to accumulate paper dust on their ink ejection face during printing. This accumulation of paper dust is highly undesirable.

In the worst case scenario, paper dust blocks nozzles on the printhead, preventing those nozzles from ejecting ink. More usually, paper dust overlies nozzles and partially covers nozzle apertures. Nozzle apertures that are partially obscured or blocked produce misdirected ink droplets during printing—the ink droplets are deflected from their intended trajectory by particulates on the ink ejection face. Misdirects are highly undesirable and may result in acceptably low print quality.

One measure that has been used for maintaining printheads in an operational condition is sealing the printhead, which prevents the ingress of particulates and also prevents evaporation of ink from nozzles. Commercial inkjet printers are typically supplied with a sealing tape across the printhead, which the user removes when the printer is installed for use. The sealing tape protects the primed printhead from particulates and prevents the nozzles from drying up during transit. Sealing tape also controls flooding of ink over the printhead face.

Aside from one-time use sealing tape on newly purchased printers, sealing has also been used as a strategy for maintaining printheads in an operational condition in between print jobs. In some commercial printers, a gasket-type sealing ring and cap engages around a perimeter of the printhead when the printer is idle. A vacuum may be connected to the sealing cap and used to suck ink from the nozzles, unblocking any nozzles that have dried up. However, whilst sealing/vacuum caps may prevent the ingress of particulates from the atmosphere, such measures do not remove particulates already built up on the printhead.

In order to remove flooded ink from a printhead after vacuum flushing, prior art maintenance stations typically employ a rubber squeegee, which is wiped across the printhead. Particulates are removed from the printhead by flotation into the flooded ink and the squeegee removes the flooded ink having particulates dispersed therein.

However, rubber squeegees have several shortcomings when used with MEMS pagewidth printheads. A typical MEMS printhead has a nozzle plate comprised of a hard, durable material such as silicon nitride, silicon oxide, aluminium nitride etc. Moreover, the nozzle plate is typically relatively abrasive due to etched features on its surface. On the one hand, it is important to protect the nozzle plate, comprising sensitive nozzle structures, from damaging exposure to the shear forces exerted by a rubber squeegee. On the other hand, it is equally important that a rubber squeegee should not be damaged by contact with the printhead and reduce its cleaning efficacy.

In our earlier U.S. patent application Ser. Nos. 11/246,707, 11/246,706, 11/246,705, 11/246,708all filed Oct. 11, 2005 and 11/482,958, 11/482,955 and 11/482,962, all filed Jul. 10, 2006, the contents of which are herein incorporated by reference, we described a method for removing particulates from a printhead. This involves flooding the printhead face with ink and transferring the flooded ink onto a transfer surface moving past the face, but not in contact with the face.

It would be desirable to provide an ink jet printhead maintenance station and method that consume minimal quantities of ink during maintenance cycles and provides effective removal of particulates from the printhead face without any damaging contact therewith.

SUMMARY OF THE INVENTION

In a first aspect the present invention provides a method of removing particulates from an ink ejection face of a printhead, said method comprising the steps of:

(i) providing a liquid foam on said face, thereby dispersing said particulates in said foam; and (ii) transferring said foam, including said particulates, onto a transfer surface moving past said face.

Optionally, said transfer surface does not contact said face.

Optionally, said foam collapses to a liquid droplet as it is transferred onto said transfer surface.

Optionally, said liquid foam is an ink foam.

Optionally, ink in said ink foam is provided by ink contained in said printhead.

Optionally, said ink foam is provided by passing a gas through ink supply channels in said printhead, thereby expelling the ink foam from nozzles in said ink ejection face.

Optionally, air is forced under pressure though said ink channels.

Optionally, said transfer surface contacts said foam when moving past said face.

Optionally, said transfer surface is less than 1 mm from said face when moving past said face.

Optionally, said transfer surface is moved past said face immediately as said foam is provided on said face.

Optionally, said transfer surface is a surface of a film.

Optionally, said transfer surface is an outer surface of a first transfer roller.

Optionally, said transfer surface is moved past said face by rotating said roller.

Optionally, said roller is substantially coextensive with said printhead.

In a further aspect the present invention provides a method further comprising the step of:

(iii) removing foam or ink from said transfer surface using an ink removal system.

Optionally, said transfer surface is an outer surface of a first transfer roller and said ink removal system comprises a cleaning pad in contact with said first transfer roller.

Optionally, said transfer surface is an outer surface of a first transfer roller and said ink removal system comprises a second transfer roller engaged with said first transfer roller.

Optionally, said second transfer roller has a wetting surface for receiving ink from said transfer surface.

Optionally, said second transfer roller is a metal roller.

Optionally, a cleaning pad is in contact with said second transfer roller.

In a second aspect the present invention provides a printhead maintenance system for maintaining a printhead in an operable condition, said maintenance system comprising:

(a) a printhead having an ink ejection face;

(b) a foaming system for providing a liquid foam on said face; and (c) a foam transport assembly comprising:

a transfer surface for receiving the foam from said face; and a transport mechanism for feeding said transfer surface through a transfer zone and away from said printhead, wherein said transfer zone is adjacent to and spaced apart from said face.

Optionally, said liquid foam is an ink foam.

In a further aspect there is provided a maintenance system further comprising a valve configurable in first and second positions, wherein in a first position said printhead is in fluid communication with an ink supply system and in a second position said printhead is in fluid communication with said foaming system.

Optionally, said foaming system supplies a gas to ink supply channels in said printhead, thereby expelling an ink foam from nozzles in said ink ejection face.

Optionally, said foaming system comprises a pump for supplying air to said ink supply channels.

Optionally, said foaming system comprises an accumulator vessel pressurizable by said pump.

Optionally, said foaming system is configured such that said pump and said accumulator vessel cooperate to supply pressurized air to said ink supply channels.

Optionally, said foaming system comprises a foam dispenser having a nozzle for dispensing a liquid foam onto said face.

Optionally, said transfer surface is a surface of a film.

Optionally, said transfer surface is an outer surface of a first transfer roller.

Optionally, said transfer surface is fed through said transfer zone by rotating said roller.

Optionally, said roller is substantially coextensive with said printhead.

Optionally, said transfer zone is spaced less than 1 mm from said face.

Optionally, said ink transport assembly is moveable between a first position in which said transfer surface is positioned in said transfer zone and a second position in which said transfer surface is positioned remotely from said printhead.

In a further aspect there is provided a maintenance system further comprising:

(d) an ink removal system for removing ink from said transfer surface.

Optionally, said transfer surface is an outer surface of a first transfer roller and said ink removal system comprises a cleaning pad in contact with said first transfer roller.

Optionally, said transfer surface is an outer surface of a first transfer roller and said ink removal system comprises a second transfer roller engaged with said first transfer roller.

Optionally, said second transfer roller has a wetting surface for receiving ink from said transfer surface.

Optionally, a cleaning pad is in contact with said second transfer roller.

In a further aspect there is provided a maintenance system further comprising a control system for coordinating the transport mechanism with said foaming system.

Optionally, said control system is configured to activate said transport mechanism at the same time as said foaming system is activated to provide a liquid foam on said face.

In a third aspect the present invention provides a printhead assembly comprising:

(a) a printhead having an ink ejection face;

(b) an ink supply system for supplying ink to said printhead; and (c) a foaming system for providing a liquid foam on said face.

Optionally, said assembly is configurable such that ink supply channels in said printhead are in fluid communication either with said ink supply system or said foaming system.

Optionally, in a printing configuration, said printhead is in fluid communication with said ink supply system, and in a maintenance configuration, said printhead is in fluid communication with said foaming system.

In a further aspect there is provided a printhead assembly further comprising a valve configurable in first and second positions, wherein in a first position said printhead is in fluid communication with said ink supply system and in a second position said printhead is in fluid communication with said foaming system.

Optionally, said foaming system supplies a gas to ink supply channels in said printhead, thereby expelling an ink foam from nozzles in said ink ejection face.

Optionally, said foaming system comprises a pump for supplying air to said ink supply channels.

Optionally, said foaming system comprises an accumulator vessel pressurizable by said pump.

Optionally, said foaming system is configured such that said pump and said accumulator vessel cooperate to supply pressurized air to said ink supply channels.

Optionally, said ink supply system comprises a priming/de-priming system for de-priming said nozzles prior to foaming and/or re-priming said nozzles with ink after foaming.

Optionally, said foaming system comprises a foam dispenser having a nozzle for dispensing a liquid foam onto said face.

Optionally, said ink supply system comprises one or more ink reservoirs.

In a further aspect there is provided a printhead assembly further comprising:

(d) a foam removal system for removing the liquid foam from said face.

Optionally, the foam removal system comprises a transfer surface onto which said foam collapses.

Optionally, said transfer surface does not contact said face.

As used herein, the term "ink" refers to any liquid fed from an ink reservoir to the printhead and ejectable from nozzles in the printhead. The ink may be a traditional cyan, magenta, yellow or black ink. Alternatively, the ink may be an infrared ink, Alternatively, the 'ink' may be a cleaning liquid (e.g. water, dyeless ink base, surfactant solution, glycol solution etc.) which is not used for printing, but instead used specifically for cleaning the ink ejection face of the printhead (see Applicant's earlier application Ser. Nos. 11/482,976 and 11/482,973 both filed Jul. 10, 2006, the contents of which are incorporated herein by reference).

The present application, in its preferred form, advantageously allows particulates to be removed from a printhead, whilst avoiding contact of the printhead with an external cleaning device. Hence, unlike prior art squeegee-cleaning methods, the cleaning action of the present invention does not impart any shear forces across the printhead and minimizes damage sensitive nozzle structures. Moreover, the transfer surface in the present invention, which does not come into contact with the printhead, is not damaged by the printhead and can therefore be used repeatedly whilst maintaining optimal cleaning action.

A further advantage of the present invention is that it consumes relatively little ink compared to prior art suction devices and systems requiring printhead face flooding. In particular, the present invention requires a fraction of the ink used by maintenance systems requiring flooding the printhead face with ink (see, for example, 11/246,707, 11/246,706, 11/246,705, 11/246708 all filed Oct. 11, 2005 and 11/482,958, 11/482,955 and 11/482,962 all filed Jul. 10, 2006).

A further advantage of the present invention is that a foam has been found to be more efficacious than flooded ink in removing particulates from a printhead face. An explanation of this improved efficacy is provided in more detail below.

BRIEF DESCRIPTION OF THE DRAWINGS

Specific forms of the present invention will be now be described in detail, with reference to the following drawings, in which:—

DETAILED DESCRIPTION OF SPECIFIC EMBODIMENTS

Printhead Maintenance System with Ink Foaming System

Figure 1:
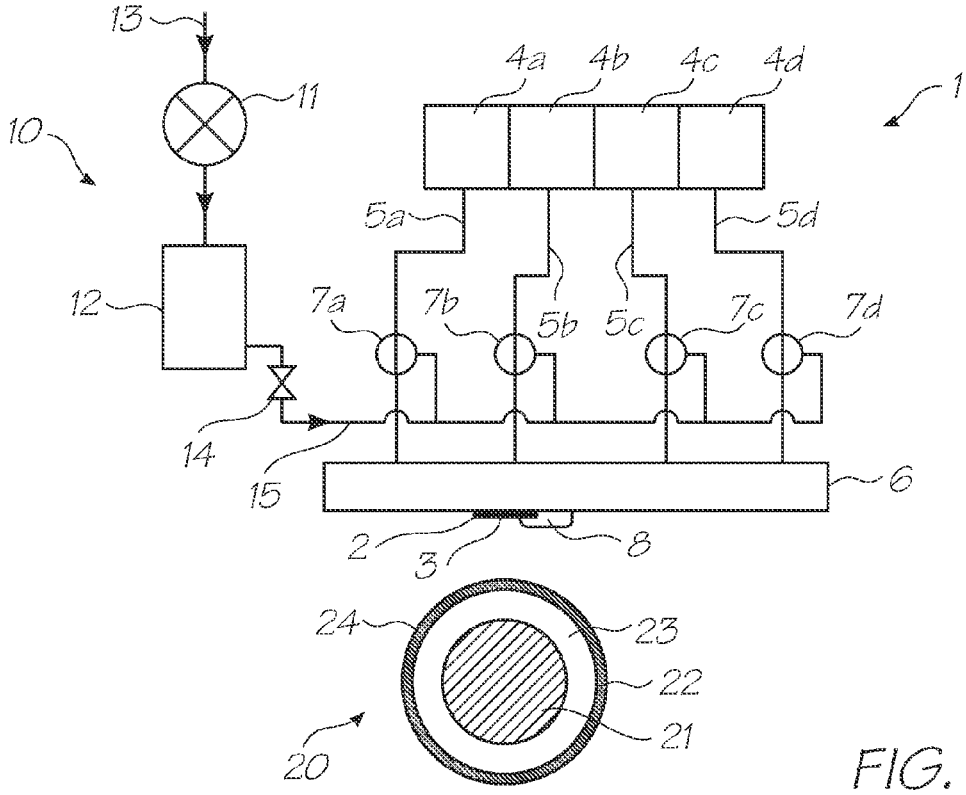
FIG. 1 is a schematic view of a printhead maintenance system according to the present invention.

Referring to FIG. 1, there is shown a printhead maintenance system 1 for maintaining a printhead 2 in an operable condition. During printing, paper dust and other particulates may build up on the ink ejection face 3 of the printhead 2, leading to misdirected ink droplets from partially obscured nozzles or even blocked nozzles. Paper dust is a particular problem in high-speed printing where paper is fed over a paper guide at high speed, generating relatively high abrasive forces compared to low-speed printing. The printhead maintenance system 1 is configured to maintain the printhead in an optimal operating condition by removing particulates from the ink ejection face 3 and/or unblocking nozzles which may be blocked with particulates.

The printhead maintenance system 1 comprises a plurality of ink reservoirs 4*a*, 4*b*, 4*c* and 4*d*, each supplying ink to the printhead 2 via respective ink conduits 5*a*, 5*b*, 5*c* and 5*d*. The printhead 2 is attached to an ink manifold 6, which directs ink supplied by the ink conduits 5*a*, 5*b*, 5*c* and 5*d* into a backside of the printhead. A plurality of solenoid valves 7*a*, 7*b*, 7*c* and 7*d* are positioned in respective ink conduits 5*a*, 5*b*, 5*c*, 5*d* and are controlled by a printhead maintenance control system.

Each valve 7 may be configured for either normal printing or printhead maintenance. In a first printing configuration, as shown in FIG. 1, each valve 7*a*, 7*b*, 7*c* and 7*d* provides fluid communication between the printhead 2 and the ink reservoirs 4*a*, 4*b*, 4*c* and 4*d*. In a second maintenance configuration, as shown in FIG. 2, each valve 7*a*, 7*b*, 7*c* and 7*d* provides fluid communication between the printhead 2 and a foaming system 10.

The foaming system 10 comprises a pump 11 having an air inlet 13 and an outlet connected to an accumulator vessel 12. With a stop-valve 14 closed, the pump 11 charges the accumulator vessel 12 to a predetermined pressure. When an ink foam on the printhead face 3 is required, the valves 7*a*, 7*b*, 7*c* and 7*d* are connected to the foaming system 10. The stop-valve 14 is then opened to force pressurized air from the accumulator vessel 12 into the printhead 2 via an air conduit 15. The pressurized air foams any ink in the printhead 2 and the resultant ink foam 30 is expelled through nozzles in the printhead onto the ink ejection face 3. FIG. 2 shows the printhead 2 having an ink foam 30 across its ink ejection face 3.

Figure 2:
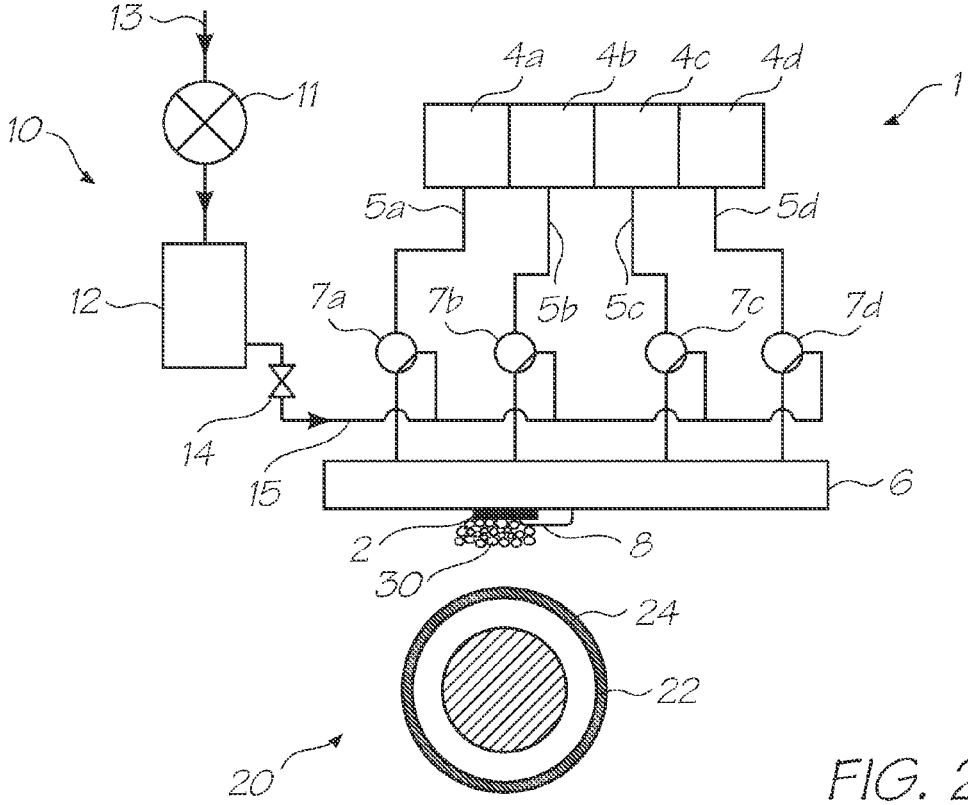
FIG. 2 is a schematic view of the printhead maintenance system shown in FIG. 1 with an ink foam provided across the printhead.
Figure 3:
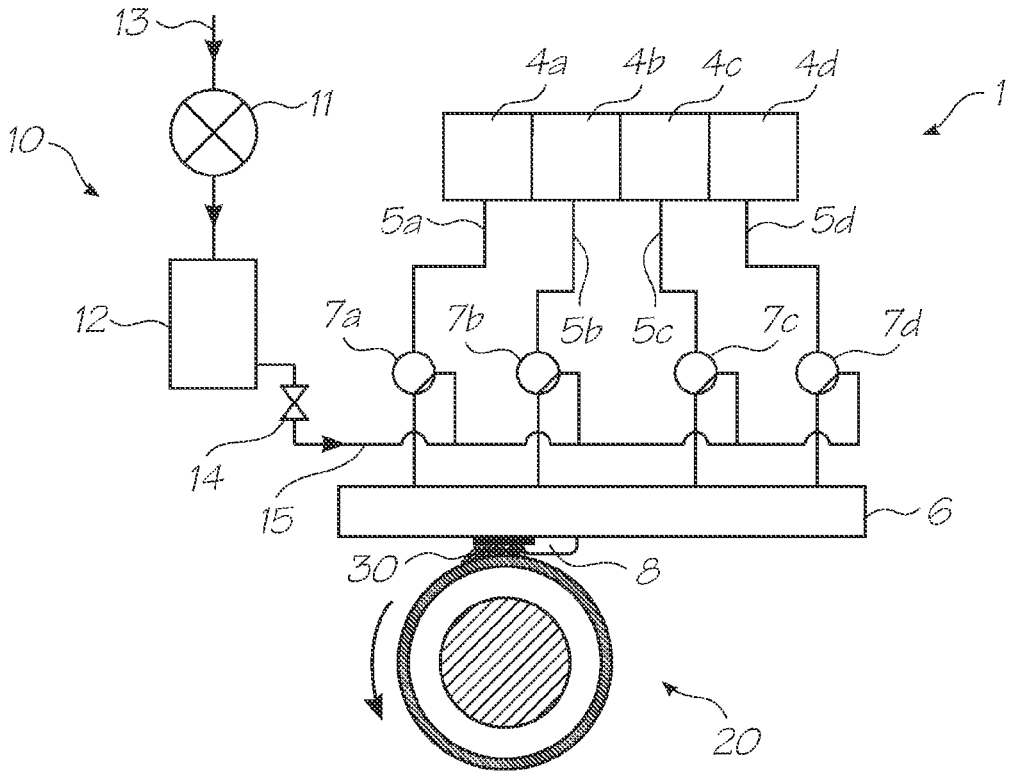
FIG. 3 is a schematic view of the printhead maintenance system shown in FIG. 2 with the transfer surface positioned in the transfer zone.

As shown in FIG. 2, the ink foam 30 is generated without a transfer roller 20 in a maintenance position. However, the ink foam 30 preferably generated with the transfer roller 20 in its maintenance position, whilst initiating rotation of the roller at about the same time as the foam is generated, as shown in FIG. 3. This prevents the ink foam 30 from spreading excessively over other printer components, such as a wire-bond encapsulant 8 which covers wire-bonds connecting the printhead 2 to power and logic provided by a print controller (not shown).

Foaming may be performed on a fully primed or a de-primed printhead 2. If the printhead 2 is de-primed, there is generally still sufficient residual ink (ca. 0.1 mL) in ink channels in the ink manifold 6 and/or printhead 2 to generate an ink foam 30 across the ink ejection face 3. Obviously, if the printhead 2 is fully primed, then more ink will be consumed by foaming. Accordingly, foaming a de-primed printhead 2 has the advantage of consuming less ink. In our earlier U.S. patent application Ser. Nos. 11/482,982, 11/482,983, 11/482,984 and simultaneously co-filed U.S. Application SBF004US (temporarily identified by its docket number), which are all incorporated herein by reference, describe methods of priming and de-priming a printhead for storage or maintenance operations. SBF004US describes a printer fluidics system, which incorporates an ink supply system suitable for priming/de-priming a printhead and foaming system for providing a foam across the printhead face. It will be understood that the maintenance system of the present invention may include the system described in SBF004US.

Not only does the ink foam 30 consume less ink than merely flooding the ink ejection face 3, it also provides for more efficacious removal of particulates 32. Whereas flooded ink relies primarily on flotation of particulates 32 into the ink, the ink foam 30 provides a multidirectional attractive force onto each particulate, which encourages the particulates to become entrained in the foam, as opposed to remaining on the printhead face 3.

Figure 4A:
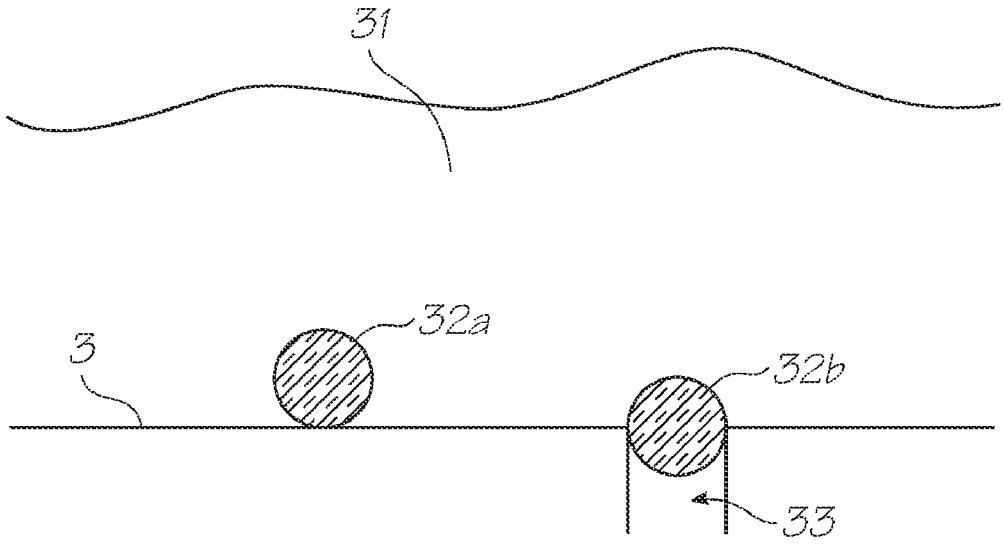
FIG. 4A is a magnified view of particulates trapped on a printhead face and covered with flooded ink.
Figure 4B:
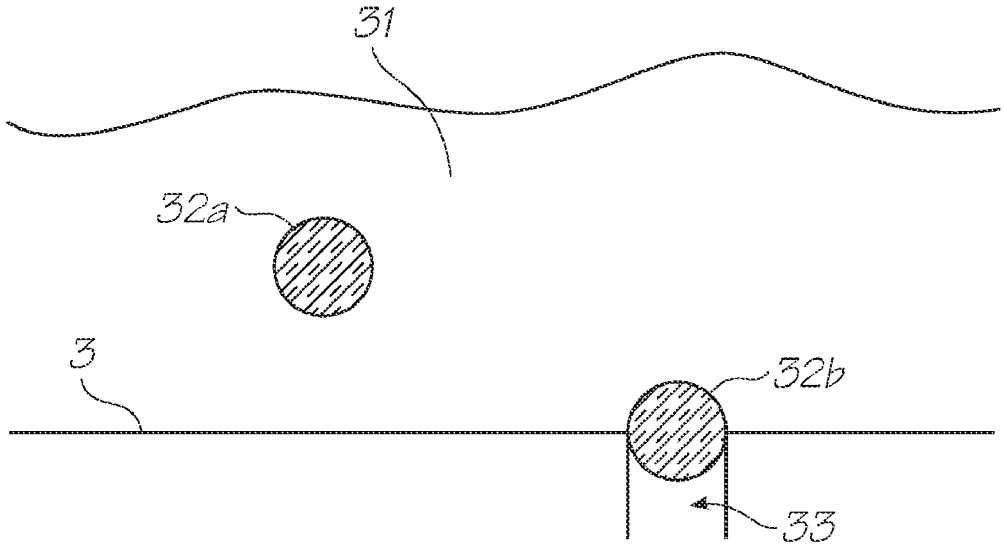
FIG. 4B shows one of the particulates in FIG. 4A floating in the flooded ink.

FIGS. 4 and 5 compare flooded ink 31 and ink foam 30 as a means for removing particulates 32 from an ink ejection face 3 having a nozzle 33. In FIG. 4A, there is shown one particulate 32*a* resting on the ink ejection face 3 and another particulate 32*b* trapped partially inside a nozzle 33. As shown in FIG. 4B, the flooded ink 31 provides sufficient flotation force on particulate 32*a* to lift it away from the face 3 and the particulate 32*a* becomes dispersed in the flooded ink 31. However, the relatively weak flotation force is insufficient to lift the other particulate 32*b* out of the nozzle 33 and it remains trapped, meaning that the nozzle 33 is blocked and inoperative.

Figure 5A:
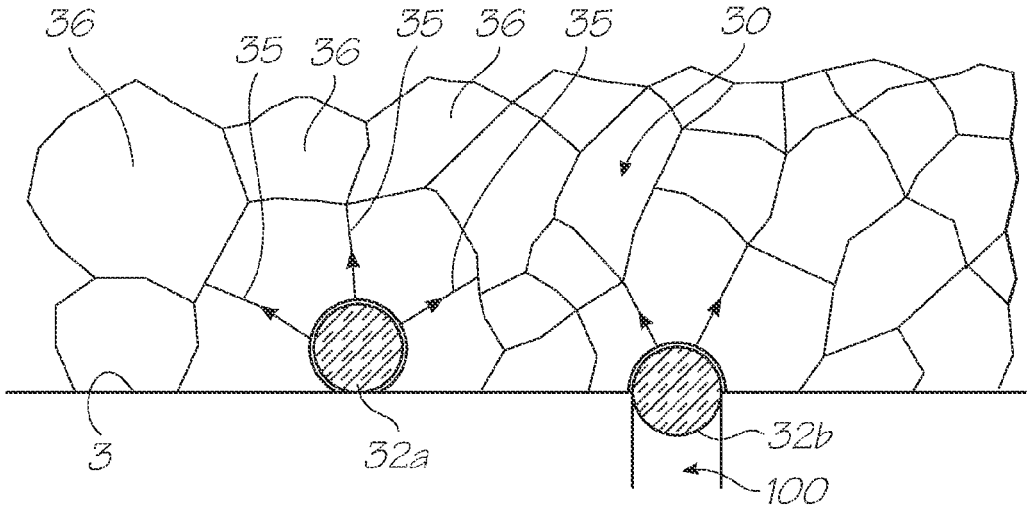
FIG. 5A is a magnified view of particulates trapped on a printhead face and covered with an ink foam.

FIG. 5A, on the other hand, shows the same two particulates 32*a* and 32*b* surrounded by the ink foam 30. The foam 30 comprises randomly-packed Voronoi polyhedra. Ink is contained in Plateau borders 35 between adjacent polyhedra, with voids 36 in the foam 30 being filled with air. Each Plateau border 35, where it meets a particulate 32, exerts an attractive force on that particulate. Given the random nature of the foam 30, each particulate receives a multidirectional lifting force as indicated by the arrows in FIG. 4A. The result is that each particulate 32 receives a stronger force lifting it away from the ink ejection face 3. As shown in FIG. 4B, this stronger multidirectional force is sufficient to not only lift the particulate 32*a* away from the face 3, but also dislodge the particulate 32*b*, which is more firmly trapped in the nozzle 100.

The particulates 32*a* and 32*b* become entrained or dispersed into the foam 30 and occupy positions defined by Plateau border vertices.

In addition, and depending on the pressure in the accumulator vessel 12, the blast of air through the printhead nozzles (e.g. 33) during foaming will also have the effect of dislodging particulates 32 which may be trapped in or on the nozzles themselves.

Figure 6:
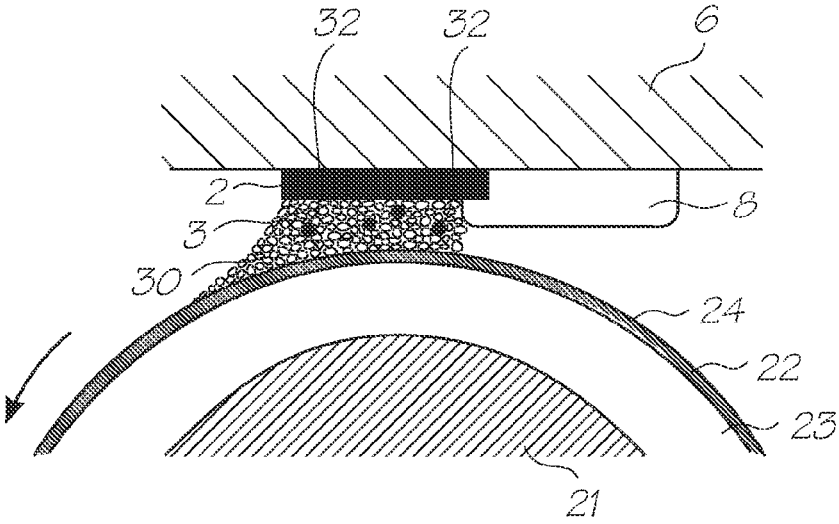
FIG. 6 is an enlarged view of the transfer zone in FIG. 3.
Figure 5B:
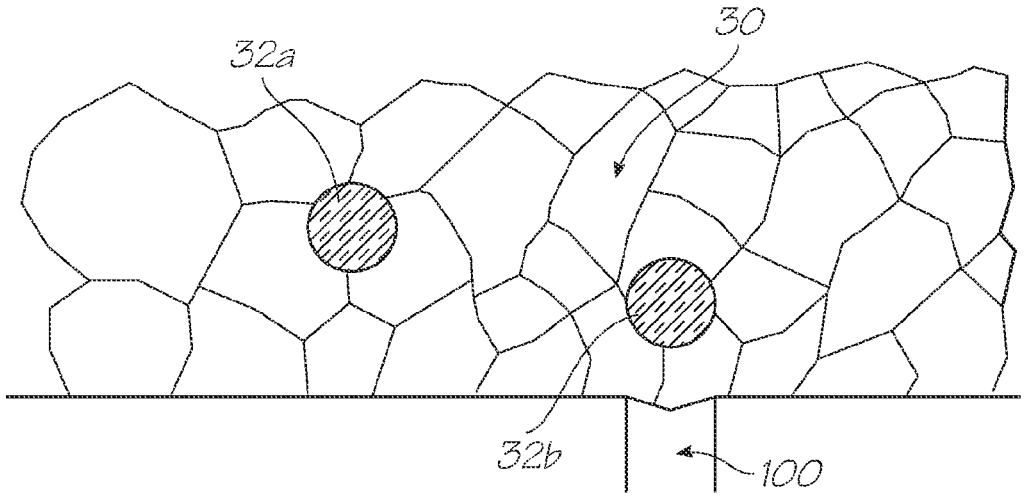
FIG. 5B is a magnified view of particulates entrained in the ink foam shown in FIG. 5A.

Having entrained the particulates 32 into the foam 30, as shown in FIGS. 5B and 6, the foam is then transferred onto a transfer surface 24 and transported away from the printhead 2. Generally, the ink foam 30 collapses to an ink droplet upon contact with the transfer surface 24. The surface characteristics and movement of the transfer surface 24 ensure that the ink foam 30 collapses onto the transfer surface and not back onto the printhead face 3. As mentioned earlier, foam generation and foam transfer preferably occur simultaneously so as to avoid excessive spreading of the foam 30.

Referring now to FIG. 6, there is shown a first transfer roller 20 comprising a stainless steel core roller 21 having an outer transfer film 22. A resiliently deformable intermediate layer 23 is sandwiched between the transfer film 22 and the core roller 21. The first transfer roller 20 is coextensive with the printhead 2, which is a pagewidth inkjet printhead. Hence, the metal roller 21 provides rigidity in the first transfer roller 20 along its entire length.

An outer surface of the transfer film 22 defines the transfer surface 24, which receives the ink foam 30 during printhead maintenance operations. The intermediate layer 23 provides resilient support for the transfer film 22, thereby allowing resilient engagement between the transfer surface 24 and an ink removal system (not shown in FIG. 6).

The first transfer roller 20 is moveable between a printing configuration (as shown in FIG. 1) in which the roller is distal from the printhead 2, and a printhead maintenance configuration (as shown in FIG. 6) in which the transfer surface 24 is positioned in a transfer zone. When positioned in the transfer zone, the transfer surface 24 is adjacent to but not in contact with the ink ejection face 3 of the printhead 2. The transfer surface 24 may or may not be in contact with the wire-bond encapsulant 8 bonded along an edge portion of the printhead 2 when it is positioned in the transfer zone.

The first transfer roller 20 is rotatable about its longitudinal axis so as to allow the transfer surface 24 to be fed through the transfer zone and away from the printhead 2. Rotation of the first transfer roller 20 is provided by means of a transport mechanism (not shown in FIG. 1), operatively connected to the core roller 21. The transport mechanism typically comprises a simple motor operatively connected to the core roller 21 via a gear mechanism.

A method of maintaining of removing particulates the ink ejection face 3 of the printhead 2 will now be described with reference to FIGS. 1, 3, 6 and 7. Initially, as shown in FIG. 1, the first transfer roller 20 is in an idle or printing position, with the transfer surface 24 distal from the printhead 2. During idle periods or during printing, the valve 14 is closed and the accumulator vessel 12 is charged with air by the pump 11. Hence, the accumulator vessel 12 is charged with pressurized air in readiness for maintenance operations.

When printhead maintenance is required, the first transfer roller 20 is moved into its printhead maintenance position, in which the transfer surface 24 is positioned in a transfer zone adjacent the ink ejection face 3, as shown in FIGS. 3 and 6. Typically, a minimum distance between the transfer zone and the ink ejection face 3 is less than about 2 mm, or less than about 1 mm, or less than about 0.5 mm.

Next, the valves 7*a*, 7*b*, 7*c* and 7*d* are configured so that ink channels in the printhead 2 communicate with the foaming system 10 (as shown in FIG. 3) rather than the ink reservoirs 4*a*, 4*b*, 4*c* and 4*d*. An ink foam 30 is then generated by opening the stop-valve 14 and at the same time the transfer roller 20 is rotated.

As shown more clearly in FIG. 6, the ink foam 30 has particulates 32 of paper dust entrained therein, which have lifted from the ink ejection face 3. The ink foam 30, including its entrained particulates 32, is transferred onto the transfer surface 24 by rotation of the first transfer roller 20, thereby feeding the transfer surface through the transfer zone and away from the printhead 2. The transfer film 22 may be a plastics film comprised of polyethers, polyolefins (e.g. polyethylene, polypropylene), polycarbonates, polyesters or polyacrylates. Typically, the transfer film is comprised of a wetting or hydrophilic material to maximize transfer of ink onto the transfer surface 24. Accordingly, the transfer film 22 may be comprised of a hydrophilic polymer or, alternatively, the transfer surface 24 may be coated with a hydrophilic coating (e.g. silica particle coating) to impart wetting properties. A polyoxymethylene transfer film 22 is particularly preferred due to its relatively wetting surface characteristics.

As shown in FIGS. 3 and 6, the first transfer roller 20 is rotated anticlockwise so that the transfer surface 24 transports ink away from the side of the printhead 2 not having the encapsulant 8 bonded thereto. This arrangement maximizes the efficacy of ink transfer.

Figure 7:
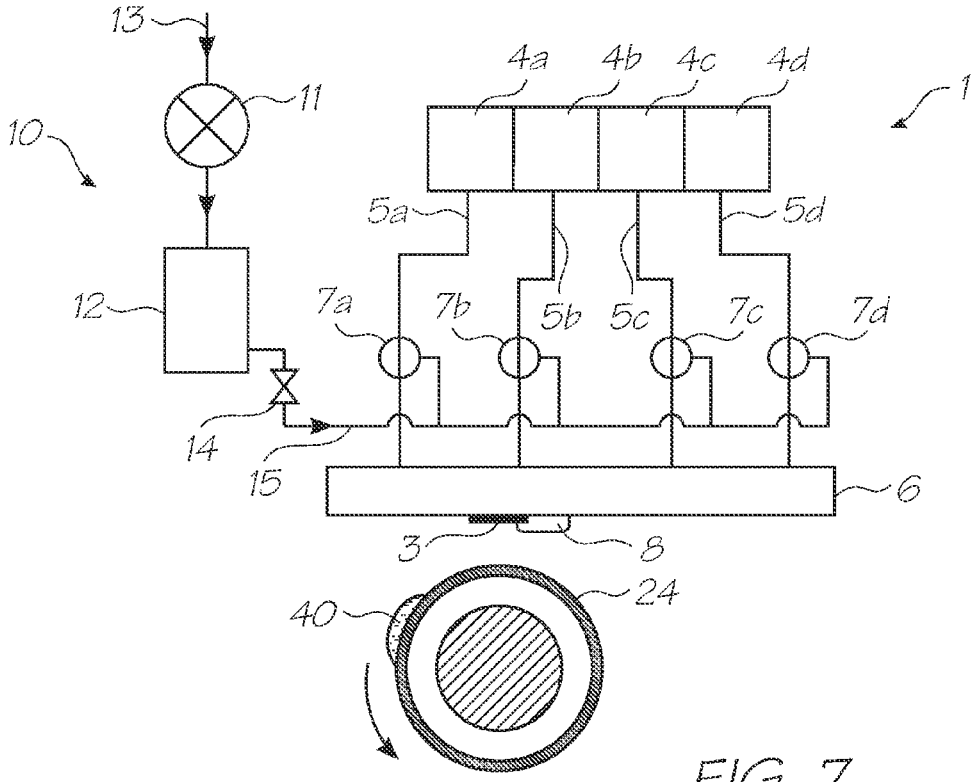
FIG. 7 is a schematic view of the printhead maintenance station shown in FIG. 1 with ink being transported on a transfer surface.

Referring now to FIG. 7, there is shown the printhead maintenance system 1 after completion of a printhead maintenance operation. The ink foam 30 has collapsed onto the transfer surface 24 as a droplet of ink 40 containing entrained particulates. The ink ejection face 3 is left clean and free of any particulates.

The ink 40 collected on the transfer surface 24 is removed by an ink removal system, which is not shown in FIGS. 1 to 7, but which will now be described in detail with reference to FIGS. 8 to 11.

Figure 8:
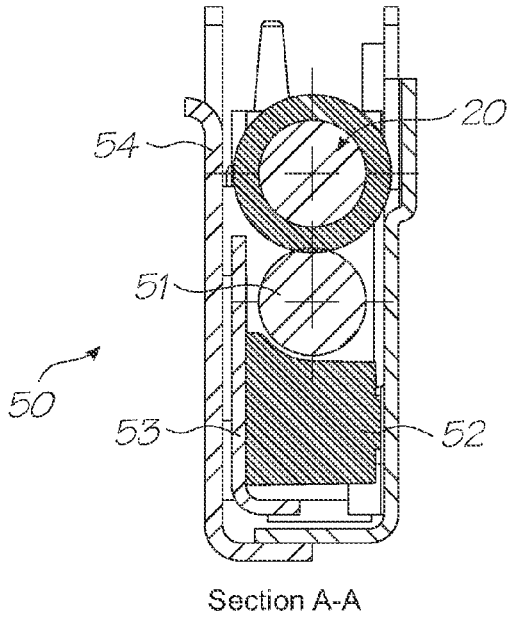
FIG. 8 is a section through line A-A of the printhead maintenance station shown in FIG. 10.

Referring initially to FIG. 8, a maintenance station 50 comprises a first transfer roller 20, as described above, engaged with a stainless steel second transfer roller 51. An absorbent cleaning pad 52 is in contact with the second transfer roller. The second transfer roller 51 and cleaning pad 52 together form the ink removal system. Ink is received from the first transfer roller 20 and deposited onto the cleaning pad 52 via the highly wetting surface of the second transfer roller 51.

It is, of course, possible for the second transfer roller 51 to be absent in the ink removal system, and for the cleaning pad 52 to be in direct contact with the first transfer roller 20. Such an arrangement is clearly contemplated within the scope of the present invention. However, the use of a metal second transfer roller 51 has several advantages. Firstly, metals have highly wetting surfaces (with contact angles approaching 0°), ensuring complete transfer of ink from the first transfer roller 20 onto the second transfer roller 51. Secondly, the metal second transfer roller 51, unlike a directly contacted cleaning pad, does not generate high frictional forces on the transfer surface 24. The metal second transfer roller 51 can slip relatively easily past the cleaning pad 52, which reduces the torque requirements of a motor (not shown) driving the rollers and preserves the lifetime of the transfer surface 24. Thirdly, the rigidity of the second transfer roller 51 provides support for the first transfer roller 20 and minimizes any bowing. This is especially important for pagewidth printheads and their corresponding pagewidth maintenance stations.

Figure 11:
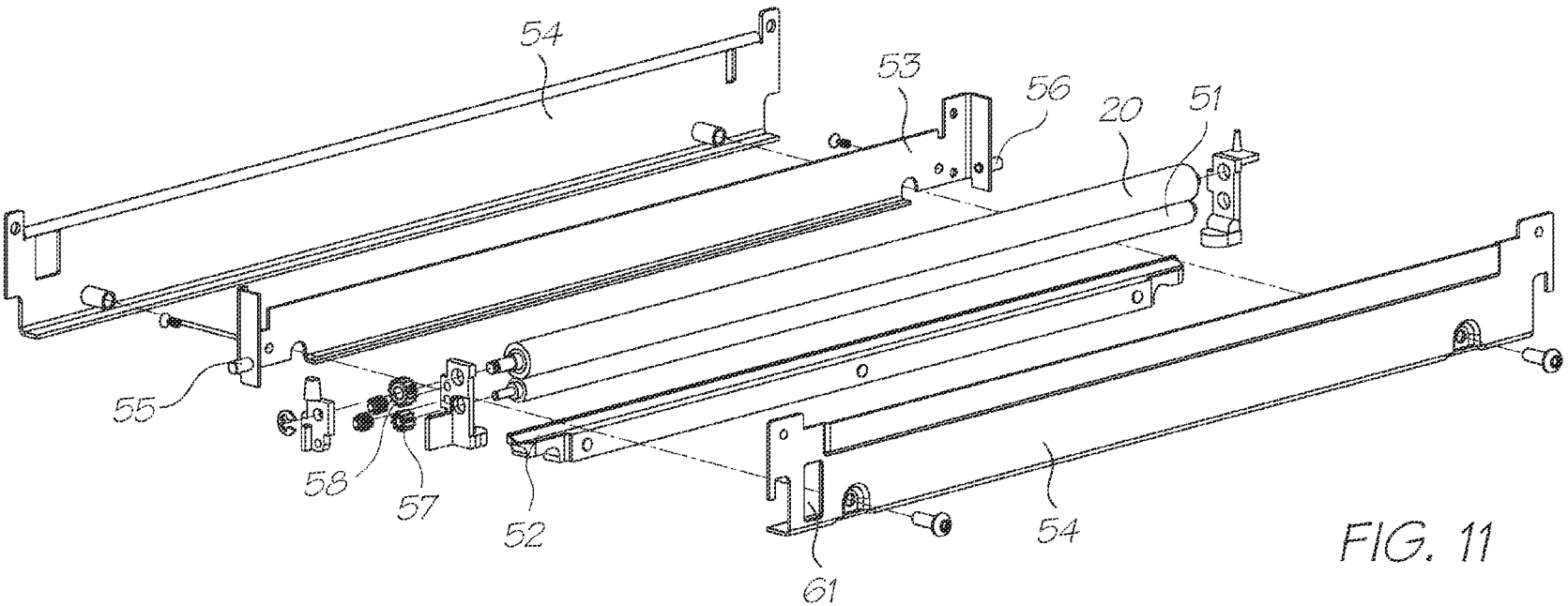
FIG. 11 is an exploded perspective view of the printhead maintenance station shown in FIG. 10.

As shown more clearly in FIG. 11, the first transfer roller 20, second transfer roller 51 and cleaning pad 52 are all mounted on a moveable chassis 53. The chassis 53 is moveable perpendicularly with respect to the ink ejection face 3, such that the transfer surface 24 can be moved into and out of the transfer zone. The chassis 53, together with all its associated components, is contained in a housing 54. The chassis 53 is slidably moveable relative to the housing 54.

The chassis 53 further comprises engagement formations in the form of lugs 55 and 56, positioned at respective ends of the chassis. These lugs 55 and 56 are provided to slidably move the chassis 53 upwards and downwards relative to the printhead 2 by means of an engagement mechanism (not shown). Typically the engagement mechanism will comprise a pair of arms engaged with the lugs 55 and 56, and arranged so that rotational movement of the arms imparts a sliding movement of the chassis 53 via a camming engagement with the lugs.

Figure 9:
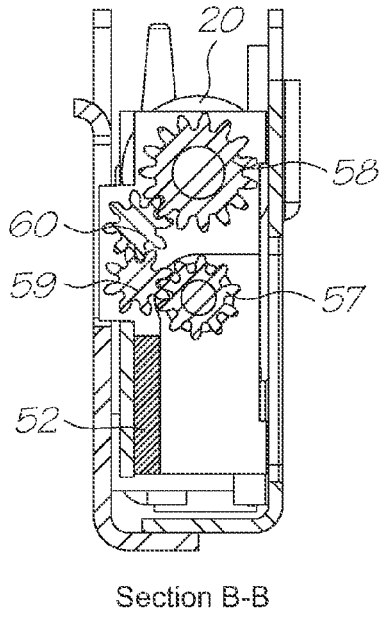
FIG. 9 a section through line B-B of the printhead maintenance station shown in FIG. 10.
Figure 10:
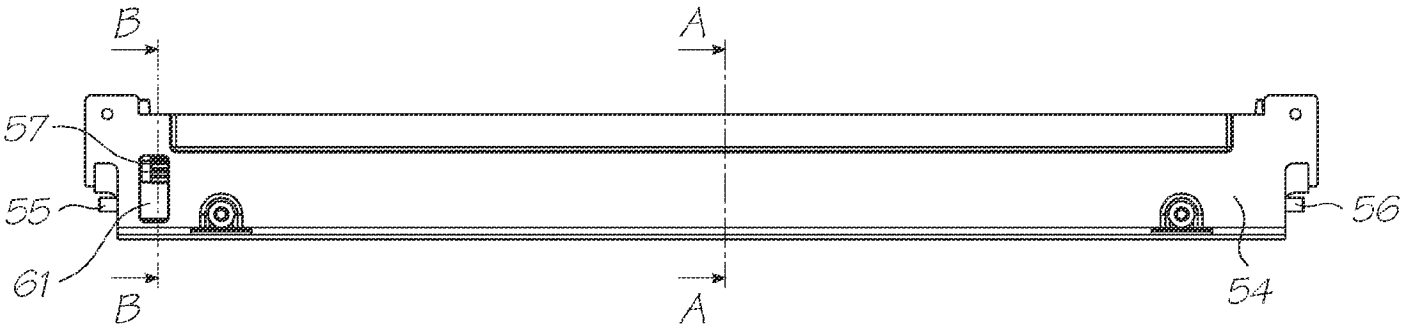
FIG. 10 is a front view of a printhead maintenance station.

Referring now to FIG. 9, it can be seen that rotation of the first and second transfer rollers 20 and 51 is via a suitable gear arrangement. A main drive gear 57, operatively mounted at one end of the second transfer roller 51, drives a subsidiary drive gear 58, operatively mounted at one end of the first transfer roller 20, via intermeshing idler gears 59 and 60. A flipper gear wheel (not shown), driven by a drive motor (not shown) can intermesh with the main drive gear 58 through a slot 61 in the housing 54 (see FIGS. 10 and 11). Hence, the gear arrangement comprising the main drive gear 57, subsidiary drive gear 58 and idler gears 59 and 60 forms part of a transport mechanism, which rotates the first and second transfer rollers 20 and 51 synchronously, thereby feeding the transfer surface 24 through the transfer zone.

Alternative Foaming System

As an alternative to the ink foaming system 10, which generates the ink foam 30 by passing air through residual ink in the printhead 2, a liquid foam may be generated by a separate foam dispenser, which does not use ink supplied to the printhead to generate the foam.

Figure 12:
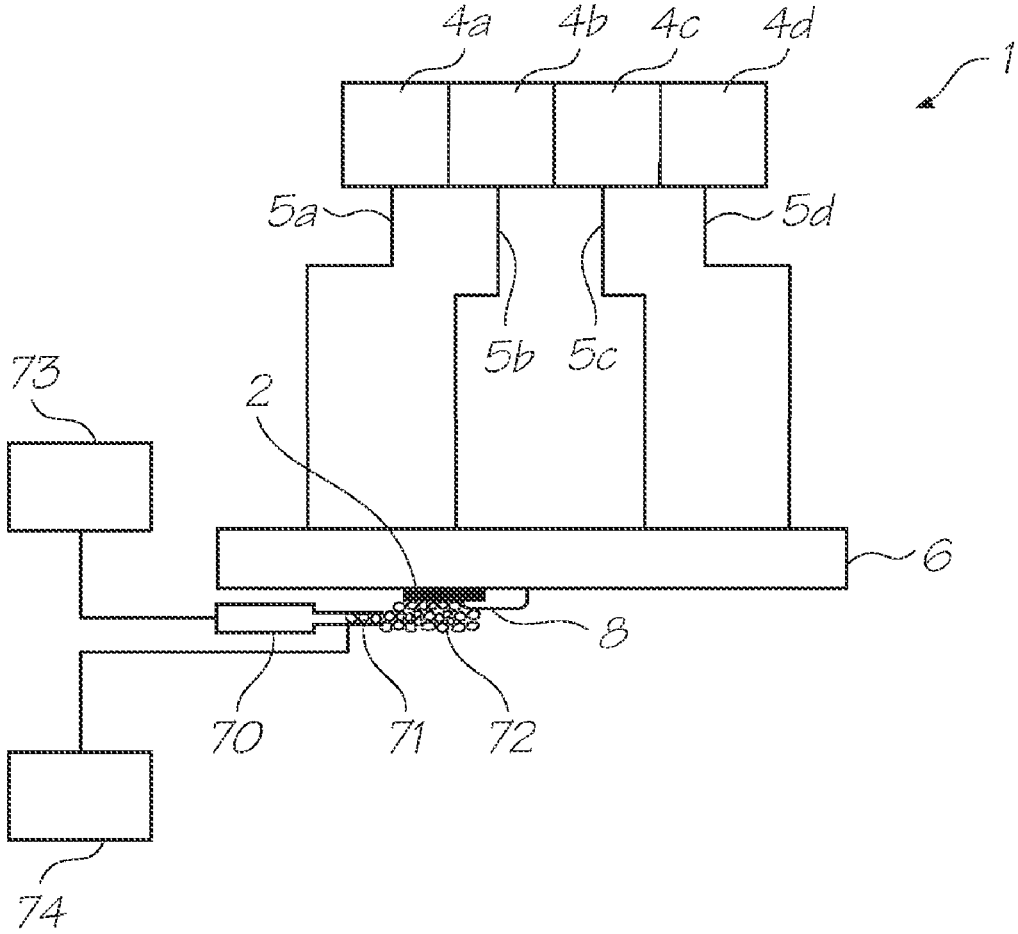
FIG. 12 is a schematic view of an alternative foaming system.

FIG. 12 shows a liquid foam dispenser 70 positioned adjacent the printhead 2. The foam dispenser 70 has a nozzle 71, which generates a liquid foam 72 by injection of pressurized gas into the nozzle. A liquid reservoir 73 feeds a liquid for foaming into the foam dispenser 70. The reservoir 73 may contain a cleaning liquid, such as water, surfactant solution, dyeless ink base, glycol solution etc. A source of pressurized gas 74 supplies the pressurized gas to the nozzle 71 for foam generation.

The liquid foam 72 provided on the ink ejection face of the printhead 2 may be removed by a transfer surface, such as the transfer surface 24 described above, moving past the face.

It will, of course, be appreciated that the present invention has been described purely by way of example and that modifications of detail may be made within the scope of the invention, which is defined by the accompanying claims.

The invention claimed is:

1. A method of cleaning an inkjet printhead, the inkjet printhead having an array of nozzles in an ink ejection face, the method comprising the steps of:

(i) generating a liquid foam on the ink ejection face such that particulate contaminants on the ejection surface disperse into the foam;

(ii) collapsing said foam, together with the particulate contaminants dispersed therein, onto a rotatable transfer film moving relative said ejection face wherein said rotatable transfer film does not contact said ejection face; and, (iii) rotating the rotatable transfer film into contact with a removal surface to remove the foam and the particulate contaminants dispersed within.

2. The method of claim 1, wherein said foam collapses to a liquid droplet as it is transferred onto said rotatable transfer film.

3. The method of claim 1, wherein said liquid foam is an ink foam.

4. The method of claim 3, wherein ink in said ink foam is provided by ink contained in said printhead.

5. The method of claim 3, wherein said ink foam is provided by passing a gas through ink supply channels in said printhead, thereby expelling the ink foam from nozzles in said ink ejection face.

6. The method of claim 5, wherein air is forced under pressure though said ink supply channels, thereby expelling the ink foam from nozzles in said ink ejection face.

7. The method of claim 1, wherein said rotatable transfer film is less than 1 mm from said ejection face when moving past said ejection face.

8. The method of claim 1, wherein said rotatable transfer film is rotated past said ejection face immediately as said foam is provided on said face.

9. The method of claim 1, wherein said rotatable transfer film is the outer surface of a roller.

10. The method of claim 9, wherein said roller is substantially coextensive with said printhead.

11. The method of claim 1, wherein said rotatable transfer film is an outer surface of a first transfer roller and said removal surface comprises a second transfer roller engaged with said first transfer roller.

12. The method of claim 11, wherein said second transfer roller has a wetting surface for receiving ink from said transfer surface.

13. The method of claim 12, wherein said second transfer roller is a metal roller.

14. The method of claim 13, wherein a cleaning pad is in contact with said second transfer roller.

15. The method of claim 1, wherein the rotatable transfer film is comprised of a plastics film having wetting surface characteristics.

* * * * *